United States Patent [19]

Kawamura et al.

[11] Patent Number: 4,478,309

[45] Date of Patent: Oct. 23, 1984

[54] SPEAKER EQUIPPED WITH DIAPHRAGM FILLED WITH FOAMED RESIN

[75] Inventors: Shinichiro Kawamura; Takahiko Irimajiri, both of Yokohama, Japan

[73] Assignee: Hitachi, Ltd., Tokyo, Japan

[21] Appl. No.: 388,242

[22] Filed: Jun. 14, 1982

[30] Foreign Application Priority Data

Jun. 19, 1981 [JP] Japan ..... 56-93880

[51] Int. Cl.[3] ..... G10K 13/00

[52] U.S. Cl. ..... 181/167; 181/166; 181/169; 181/DIG. 1; 179/181 F; 428/319.3

[58] Field of Search ..... 181/166–170, 181/DIG. 1, 146; 179/181 F; 428/316.6, 318.4, 319.1, 319.3, 319.7, 319.9

[56] References Cited

U.S. PATENT DOCUMENTS 3,093,207 6/1963 Bozak ..... 181/166
3,187,832 6/1965 Broadley ..... 181/146
4,275,278 6/1981 Sakurai et al. ..... 181/166 X

FOREIGN PATENT DOCUMENTS 30395 of 1968 Japan .
6449 of 1969 Japan .

*Primary Examiner*—Michael L. Gellner
*Assistant Examiner*—Della J. Rutledge
*Attorney, Agent, or Firm*—Antonelli, Terry & Wands

[57] ABSTRACT

A speaker provided with a diaphragm having a foamed resin body of relatively low density on its front surface includes a thin sheet of foamed resin applied to its surface. The thin sheet of foamed resin has relatively high flexural rigidity and is impermeable to air, to enable the surface of the foamed resin body to be protected against damage or indentation that might otherwise be caused. The thin sheet of foamed resin may be coated with a paint or have a foil applied to its surface. The speaker has improved electroacoustic transducing efficiency.

19 Claims, 2 Drawing Figures

SPEAKER EQUIPPED WITH DIAPHRAGM FILLED WITH FOAMED RESIN

BACKGROUND OF THE INVENTION

This invention relates to speakers and more particularly it deals with a novel speaker including a diaphragm which is a sound producing cone section filled with foamed resin of substantially low density and having a thin sheet on the surface of the foamed resin.

Diaphragms filled with foamed resin have hitherto had improved sound producing conditions and better frequency characteristics of an output sound range than diaphragms of no foamed resin, and have been able to move as a rigid body in vibration throughout the cone as a unitary structure over an entire sound range from a low to a high sound range.

Some disadvantages are, however, associated with diaphragms having foamed resin filled therein. Since a mass of foamed resin is additionally applied to the diaphragm if it has the foamed resin, the diaphragms have reduced electroacoustic transducing efficiency because of the increased mass. Thus, in order to avoid a reduction in transducing efficiency, it has hitherto been necessary to use foamed resin of as low a density as is practical as long as the end of filling the diaphragm with the resin is not defeated, to thereby minimize an increase in the mass of the diaphragm. When this is the case, there has been the disadvantage that when the operator touches the diaphragm by hand, the foamed resin might be damaged or dented.

SUMMARY OF THE INVENTION

This invention has been developed for the purpose of obviating the aforesaid disadvantages of the prior art. Accordingly the invention has as its object the provision of a diaphragm having a foamed resin body which is capable of minimizing a reduction in electroacoustic transducing efficiency while maintaining the characteristics of the foamed resin filled vibration system at a high level.

The outstanding characteristic of the invention is that a diaphragm of a cone or dome type having a foamed resin body of substantially low density on its front surface has secured to the surface of the foamed resin body a thin sheet of foamed resin or other material of substantially high flexural rigidity. The provision of the thin sheet makes it possible to avoid damage or indentation that might otherwise be caused to the foamed resin body and gives high rigidity to the diaphragm while enabling higher electroacoustic transducing efficiency to be achieved than a diaphragm filled with foamed resin of high density of the prior art.

DESCRIPTION OF THE PREFERRED EMBODIMENTS

Figure 1:
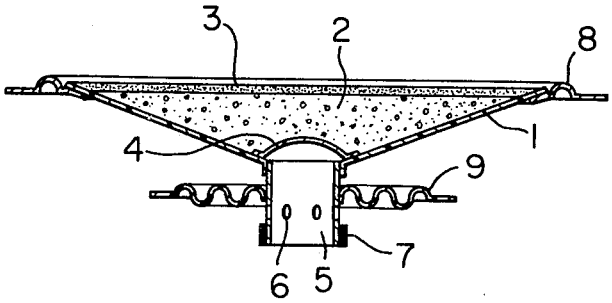
FIG. 1 is a sectional view of the vibration system of the speaker comprising one embodiment of the invention.

The invention will now be described by referring to the preferred embodiments shown in the accompanying drawings. FIG. 1 is a sectional view of the vibration system of the speaker indicating one embodiment comprising a cone 1, a foamed resin body 2 of a frustoconical shape of relatively low density, a thin sheet 3 of foamed resin of relatively high flexural rigidity, a center cap 4, a bobbin 5, ventilating apertures 6 formed in the bobbin 5, a voice coil 7, an edge suspension 8 and a centering spider 9 for supporting the bobbin 5 at its outside.

The cone 1 is formed of aluminum, paper or other material of relatively high specific modulus of elasticity in order to widen as much as possible the vibration zone of the vibration system.

The frustoconical foamed resin body 2 preferably has a lowest possible density as described hereinabove to avoid a reduction in electroacoustic transducing efficiency and need have substantially high flexural rigidity. However, if the density of the foamed resin body 2 is too low, the reason for using the foamed resin body 2 would be defeated and the condition of sound transmission would deteriorate, making it difficult to transmit sound of high frequency. A reduction in density would have a concomitant reduction in flexural rigidity, so that the surface of the foamed resin body 2 would tend to suffer damage or indentation.

In view of the foregoing, the foamed resin body 2 is formed of material, such as polyurethane, of a density of 5–30 kg/m$^3$, and the thin sheet 3 of foamed resin applied to the surface of the foamed resin body 2 is formed of material, such as foamed polyacryl resin, having a relatively high density (40 kg/m$^3$ is economical in fabrication) as compared with the material for the foamed resin body 2 and relatively high flexural rigidity (0.002–0.02 N·m), which is air-impermeable, according to the invention.

Processes for securing the thin sheet 3 of foamed resin to the surface of the foamed resin body 2 may include the following: a process in which the frustoconical foamed resin body 2 is adhesively attached to the surface of the thin sheet 3 of foamed resin, a process in which a mass of foamed resin of relatively low density is applied by using a bonding agent to the surface of the thin sheet 3 of foamed resin and then the mass of foamed resin of relatively low density is formed into a frustoconical shape, and a process in which foamed resin of relatively low density is allowed to foam on the surface of the thin sheet 3 of foamed resin to be simultaneously bonded thereto by its own adhesiveness before the bonded foamed resin of relatively low density is formed into a frustoconical shape. In the last-mentioned process, there are the possibilities that shrinkage occurring when the relatively low density foamed resin sets might cause the thin sheet 3 to buckle. To avoid this phenomenon, it would be necessary in some cases to securedly hold the thin sheet 3 on a surface table by means of a vacuum pump, by clamping peripheral portions of the thin sheet to the surface table or by applying the thin sheet to the surface table by means of surface-to-surface bonding tape.

What is important is that the thin sheet 3 of foamed resin is applied in any process as desired to the surface of the frustoconical foamed resin body 2 to provide a unitary structure which is then attached to the cone 1. Alternatively, foamed resin of relatively low density may be made to foam on the surface of the cone 1 to provide the frustoconical foamed resin body 2 while simultaneously allowing the latter to be bonded by its own adhesiveness to the former, and then the thin sheet 3 of foamed resin may be applied to the surface of the frustoconical foamed resin body 2, after severing portions of the foamed resin located in other portions than the cone 1, at the opening of the cone 1 or in the vicinity thereof.

Figure 2:
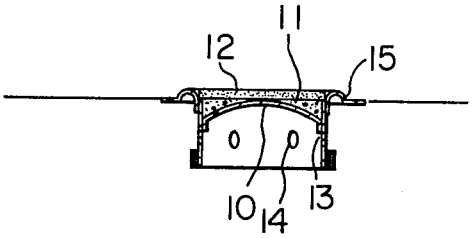
FIG. 2 is a sectional view of the second embodiment of the invention.

When the speaker is of a dome type, a dome-type diaphragm 10 shown in FIG. 2 may be adhesively bonded to the inner side of a bobbin 13 substantially at a midpoint to provide a clearance between the surface of the diaphragm 10 and the inner surface of the bobbin 13. After the clearance thus formed is filled with a concave foamed resin body 11 of substantially low density, the surface of the concave foamed resin body 11 may be used as a thin sheet 12 of e.g., foamed resin of substantially high flexural rigidity.

In the embodiments shown and described hereinabove, the front surface of the diaphragm is formed of foamed resin of relatively high flexural rigidity. By taking advantage of high flexural rigidity, the surface of the thin sheet 3 or 12 of foamed resin may be coated with a paint or have a foil applied thereto, to cover the surface of the thin sheet 3 with a coating to improve its external appearance. In diaphragms of the prior art, the surface of a foamed resin body of low density or a concave foamed resin body may be coated with a paint or have a foil applied thereto. However, the prior art has had the disadvantage that reduced bond strength of foamed resin of low density has made it impossible to prevent coating or foil from readily separating itself from the surface of the foamed resin. The invention enables the aforesaid disadvantages of the prior art to be obviated because the coating or foil applied to the surface of the thin sheet 3 of foamed resin of high flexural rigidity and relatively low density can hold the coating or foil with high bond strength.

The speaker according to the invention has a hard surface on the foamed resin body of relatively low density which is impermeable to air, thereby enabling the electroacoustic transducing efficiency of the speaker to be improved. Additionally the disadvantages of the prior art that the foamed resin diaphragm might be damaged or dented when the operator touches same by hand can be obviated, so that the need to provide the diaphragm with wire-netting or apertures to protect same can be eliminated. This is conducive to elimination of deterioration of sound quality and reduced production cost.

What is claimed is:

1. A speaker having a diaphragm filled with foamed resin, comprising:

a cylindrical type voice coil bobbin wound around with a voice coil on the periphery;

said diaphragm, being connected with said voice coil bobbin;

a foamed resin body of substantially low density located on the front surface of said diaphragm; and a thin sheet, of sufficiently high flexural rigidity such that damage or indentation of the foamed resin body can be avoided and the diaphragm achieves high rigidity, secured to the surface of said foamed resin body, said thin sheet having a flexural rigidity of 0.002–0.2 N·m and being impermeable to air.

2. A speaker as claimed in claim 1, wherein said foamed resin body of low density has a density of 5–30 $kg/m^3$.

3. A speaker as claimed in claim 2, further comprising a coating applied to the surface of said thin sheet of high flexural rigidity.

4. A speaker as claimed in claim 1, wherein said thin sheet is made of a foamed resin.

5. A speaker as claimed in claim 4, wherein the foamed resin of which the thin sheet is made has a relatively high density as compared with the density of said foamed resin body.

6. A speaker having a diaphragm filled with foamed resin, comprising:

a cylindrical type voice coil bobbin wound around with a voice coil on the periphery;

said diaphragm, made in a cone type, and connected with said voice coil bobbin;

a foamed resin body of a cone type having a flat sound emitting surface filling in the space surrounded by the inner surface of said diaphragm; and a thin sheet of foamed resin coating the surface of said sound emitting surface of said foamed resin body, said thin sheet having a sufficiently high flexural rigidity such that damage or indentation of the foamed resin body can be avoided and the diaphragm achieves high rigidity, said thin sheet having a flexural rigidity of 0.002–0.02 N·m and being impermeable to air.

7. A speaker as claimed in claim 6, wherein the foamed resin of which the thin sheet is made has a relatively high density as compared with the density of said foamed resin body.

8. A speaker having a diaphragm filled with foamed resin, comprising:

a cylindrical type voice coil bobbin wound around with a voice coil on the periphery;

said diaphragm, of a dome type and being inserted into an inner portion of said voice coil bobbin;

a space which is formed by the enclosure of the inner surface of said voice coil bobbin and the upper surface of said diaphragm;

a foamed resin body which is filled in said space and which has a flat sound emitting surface at substantially the same position as the upper end of said voice coil bobbin; and a thin sheet of foamed resin coating the surface of said sound emitting surface of said foamed resin body, said thin sheet having a sufficiently high flexural rigidity such that damage or indentation of the foamed resin body can be avoided and the diaphragm achieves high rigidity, said thin sheet having a flexural rigidity of 0.002–0.02 N·m and being impermeable to air.

9. A speaker as claimed in claim 8, wherein the foamed resin of which the thin theet is made has a relatively high density as compared with the density of said foamed resin body.

10. A speaker including a diaphragm, comprising:

a foamed resin body of substantially low density;

the diaphragm, filled with said foamed resin body and disposed so that said diaphragm is in contact with surfaces of said foamed resin body; and a thin sheet having a sufficiently high flexural rigidity such that damage or indentation of the foamed resin body can be avoided and the diaphragm achieves high rigidity, wherein the thin sheet is applied to a surface of said foamed resin body which is not in contact with said diaphrgm, said thin sheet having a flexural rigidity of 0.002–0.02 N·m and being impermeable to air.

11. A speaker as claimed in claim 10, wherein the thin sheet is made of a foamed resin material.

12. A speaker as claimed in claim 11, wherein the foamed resin material of which the thin sheet is made has a relatively high density as compared with the density of said foamed resin body, whereby the thin sheet acts to protect the foamed resin body while enabling higher electroacoustic transducing efficiency to be achieved than with a diaphragm filled with foamed resin of high density.

13. A speaker as claimed in claim 12, wherein said foamed resin body has a density of 5–30 kg/m$^3$.

14. A speaker as claimed in claim 13, wherein said foamed resin body is formed of polyurethane.

15. A speaker as claimed in claim 12, wherein said foamed resin material is polyacryl resin.

16. A speaker as claimed in claim 13, wherein said foamed resin material has a density of 40 kg/m$^3$.

17. A speaker as claimed in claim 12, wherein said diaphragm is of either a cone type or a dome type.

18. A speaker as claimed in claim 12, wherein a coating is applied to the surface of said thin sheet of foamed resin material which is not in contact with said foamed resin body.

19. A speaker as claimed in claim 18, wherein said coating is either a paint or a foil.

* * * * *